US006107749A

United States Patent [19]

Nilssen

[11] Patent Number: 6,107,749

[45] Date of Patent: Aug. 22, 2000

[54] FET-BIPOLAR ELECTRONIC BALLAST

[76] Inventor: Ole K. Nilssen, Caesar Dr., Barrington, Ill. 60010

[21] Appl. No.: 08/272,647

[22] Filed: Jul. 11, 1994

Related U.S. Application Data

[63] Continuation of application No. 07/820,918, Jan. 15, 1992, abandoned, which is a continuation-in-part of application No. 07/281,275, Dec. 7, 1988, abandoned, which is a continuation-in-part of application No. 07/080,865, Aug. 3, 1987, Pat. No. 4,819,146.

[51] Int. Cl.[7] ..... H05B 37/02

[52] U.S. Cl. ..... 315/219; 315/244; 315/307; 315/DIG. 4; 315/DIG. 5; 315/DIG. 7

[58] Field of Search ..... 315/DIG. 4, DIG. 5, 315/DIG. 7, 152, 307, 209 R, 219, 244, 224; 363/132

[56] References Cited

U.S. PATENT DOCUMENTS

| | | | |
|---|---|---|---|
| 4,346,332 | 8/1982 | Walden | 315/307 |
| 4,471,269 | 9/1984 | Ganser et al. | 315/307 |
| 4,698,553 | 10/1987 | Nilssen | 315/102 |
| 4,719,390 | 1/1988 | Sairanen | 315/307 |
| 4,933,605 | 6/1990 | Quazi et al. | 315/224 |
| 4,983,887 | 1/1991 | Nilssen | 315/307 |

*Primary Examiner*—Michael B Shingleton

[57] ABSTRACT

In a power-line-operated high-frequency electronic ballast, a half-bridge inverter is powered from a DC supply voltage and a fluorescent lamp is connected with the inverter's more-or-less asymmetrical squarewave output voltage by way of a of a series-resonant L-C circuit. The amount of power supplied by the inverter to the series-resonant L-C circuit and/or to the fluorescent lamp at any given moment depends on four significant factors: (i) the instantaneous magnitude of the DC supply voltage, (ii) the instantaneous frequency of the inverter's squarewave output voltage, (iii) the symmetry of the inverter's squarewave output voltage (which determines the effective magnitude of of its fundamental frequency voltage component), and (iv) the instantaneous operational characteristics of the fluorescent lamp. Arrangements are provided whereby the symmetry, and thereby the effective magnitude, of the inverter's output voltage is automatically adjusted so as to prevent inverter overload in case the fluorescent lamp is non-present or inoperative. The half-bridge inverter includes a bipolar transistor series-connected with a FET. The bipolar transistor operates with a substantially constant per-cycle ON-time, whereas the FET operates with a per-cycle ON-time of controllable duration.

2 Claims, 3 Drawing Sheets

FET-BIPOLAR ELECTRONIC BALLAST

RELATED APPLICATION

This is a continuation of Ser. No. 820,918 filed Jan. 15, 1992, abandoned, which is a continuation-in-part of Ser. No. 07/281,275 filed Dec. 7, 1988; which is a continuation-in-part of Ser. No. 07/080,865 filed Aug. 3, 1987, now U.S. Pat. No. 4,819,146.

BACKGROUND OF THE INVENTION

1. Field of Invention

The present invention relates to ballasts with inverters having series-tuned L-C output circuitry by which to provide a magnitude-controllable sinusoidal output voltage to a lamp load.

2. Elements of Prior Art

In inverter-type fluorescent lamp ballasts using a series-excited parallel-loaded resonant L-C circuit for matching the inverter's output to the fluorescent lamp, an important problem relates to possible damage of the inverter in case the series-excited parallel-loaded resonant L-C circuit is left unloaded, such as may occur if the fluorescent lamp were to be removed. To prevent such damage from occurring, it is necessary to provide means whereby the maximum power drawn from the inverter be manifestly limited to a safe level.

For instance, such limitation is accomplished by Zansky in U.S. Pat. No. 4,392,087 by using the inverter's DC supply as an alternative load which, by way of rectifier means, activates as soon as the output voltage exceeds a certain magnitude. Or, in U.S. Pat. No. 4,398,126 to Zuchtriegel, inverter protection is provided by way of disabling the inverter in case the L-C circuit is left unloaded.

SUMMARY OF THE INVENTION

Objects of the Invention

An object of the present invention is that of providing an improved controllable inverter-type ballast.

These, as well as other objects, features and advantages of the present invention will become apparent from the following description and claims.

BRIEF DESCRIPTION

In its preferred embodiment, the present invention constitutes a power supply having:

a) a rectifier connected with the power line and operative to provide a DC supply voltage at a pair of DC terminals;

b) a half-bridge inverter connected with the DC terminals and operative to provide a more-or-less symmetrical (or more-or-less assymmetrical) squarewave voltage at a pair of inverter terminals, the peak magnitude of this squarewave output voltage being proportional to that of the DC supply voltage;

c) a series-combination of an inductor and a capacitor connected across the inverter terminals, this L-C series-circuit being resonant at or near the fundamental frequency of the inverter's more-or-less symmetrical squarewave output voltage;

d) a fluorescent lamp load connected in parallel with the capacitor of the L-C series-circuit, the magnitude of the voltage developing across this capacitor being a function of: i) the magnitude of the inverter's output voltage, ii) the frequency of the inverter's output voltage, iii) the degree of symmetry of the inverter's squarewave output voltage (i.e., the magnitude of the fundamental frequency component of the squarewave output voltage), and iv) the magnitude of the current drawn by the lamp load; and e) control means connected in circuit with the half-bridge inverter and its L-C output circuit, the control means being operative to control the symmetry of the inverter's squarewave output voltage: i) as a function of the magnitude of the voltage developing across the capacitor of the L-C circuit and in such manner that the magnitude of the voltage developing across this capacitor will never exceed a pre-determined safe magnitude, therefore automatically preventing the L-C circuit from ever drawing an excessive amount of power from the inverter, and ii) as a function of an alternative control input.

In an initial embodiment, the inverter is self-oscillating and uses two saturable current transformers in the positive feedback loop. The saturation flux density of these saturable transformers determines the fundamental frequency of the inverter's output voltage. The saturation flux density of one of these saturable transformers versus that of the other saturable transformer determines the symmetry of the inverter's squarewave output voltage. The saturation flux density of one of the transformers is controlled by a cross-magnetic flux.

That is, control of the symmetry of the inverter's squarewave output voltage is attained by subjecting one of the saturable current transformers to a controlled degree of cross-magnetizing flux. The cross-magnetizing flux is provided by an adjacently positioned electromagnet, the magnetizing current of which has a magnitude functionally dependent on: i) the magnitude of the voltage present across the capacitor of the L-C circuit, and/or ii) the magnitude of the current flowing through an alternative control input.

In the preferred embodiment, the inverter uses only a single saturable current transformer in the positive feedback loop. This single saturable current transformer controls a bipolar transistor; which bipolar transistor is series-connected with a FET so as to form a series-combination; which series-combination is connected across the DC terminals.

The bipolar transistor and the FET each conducts (but not simultaneously) for part of the time during each cycle of the inverter's more-or-less asymmetrical squarewave output voltage. The bipolar transistor conducts for a substantially fixed period during each such cycle; whereas the FET conducts for a period of controllable duration.

The FET's conduction period is initiated each time the magnitude of its drain voltage falls below a predermined level and is terminated some controllable period thereafter. The duration of this controllable period is determined by the magnitude of a control voltage, but is prevented from being substantially longer than that of the ON-time of the bipolar transistor.

When the per-cycle ON-time of the FET is equal to that of the bipolar transistor, the inverter's output voltage is a symmetrical squarewave with a peak-to-peak magnitude equal to the magnitude of the DC voltage; which represents a situation where the fundamental voltage component of the inverter's output voltage is at its maximum magnitude. When the per-cycle ON-time of the FET is small, the peak-to-peak magnitude of the inverter's output voltage is still equal to the magnitude of the DC voltage; however, the magnitude of the fundamental voltage component is now small—substantially proportionally so.

In the preferred embodiment, the bipolar transistor may be regarded as a master transistor, the switching-ON of which is effected by positive feedback provided by way of the saturable current transformer. The FET, on the other hand, may be regarded as a slave transistor, the switching-ON of which is effected by the switching-OFF of the master transistor.

DESCRIPTION OF THE INITIAL EMBODIMENT

Details of Construction

Figure 1:
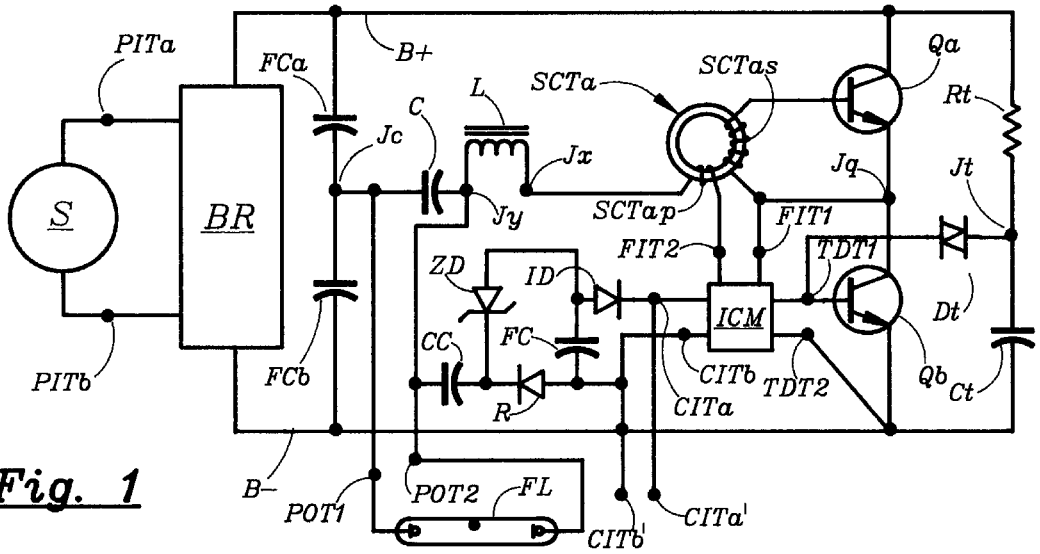
FIG. 1 provides a schematic diagram of a basic version of the initial embodiment of the invention.

FIG. 1 schematically illustrates the electrical circuit arrangement of the initial embodiment.

In FIG. 1, a source S of ordinary 120 Volt/60 Hz power line voltage is applied to power input terminals PITa and PITb; which terminals, in turn, are connected with a bridge rectifier BR. The DC output from bridge rectifier BR is applied to a B+ bus and a B− bus, with the B+ bus being of positive polarity.

A first filter capacitor FCa is connected between the B+bus and a junction Jc; and a second filter capacitor FCb is connected between junction Jc and the B− bus.

A first switching transistor Qa is connected with its collector to the B+ bus and with its emitter to a junction Jq.

A second switching transistor Qb is connected with its collector to junction Jq and with its emitter to the B− bus.

An inverter control means ICM has a pair of feedback input terminals FIT1 and FIT2, a pair of transistor drive terminals TDT1 and TDT2, and a pair of control input terminals CITa and CITb.

Input terminals FIT1 and FIT2 are series-connected with the primary winding SCTap of a saturable current transformer SCTa to form a series-combination, and this series-combination is connected between junction Jq and a junction Jx. Secondary winding SCTas is connected across the base-emitter junction of transistor Qa. Transistor drive terminals TDT1 and TDT2 are respectively connected with the base and the emitter of transistor Qb; and control input terminals CITb and CITa are respectively connected with the B− bus the cathode of an isolating diode ID. Control input terminals CITa and CITb are respectively connected with terminals CITa' and CITb'.

The anode of isolating diode ID is connected with the anode of a Zener diode ZD; whose cathode is connected with the cathode of a rectifier R; whose anode is connected with the B− bus. A filter capacitor FC is connected between the anode of Zener diode ZD and the B− bus; and a coupling capacitor CC is connected between a junction Jy and the cathode of rectifier R.

A capacitor C is connected between junction Jc and junction Jy; and an inductor L is connected between junctions Jy and Jx. Junctions Jc and Jy are respectively connected with power output terminals POT1 and POT2; across which output terminals is connected a fluorescent lamp FL.

A resistor Rt is connected between the B+ bus and a junction Jt; a capacitor Ct is connected between junction Jt and the B− bus; and a Diac Dt is connected between junction Jt and the base of transistor Qb.

Figure 2:
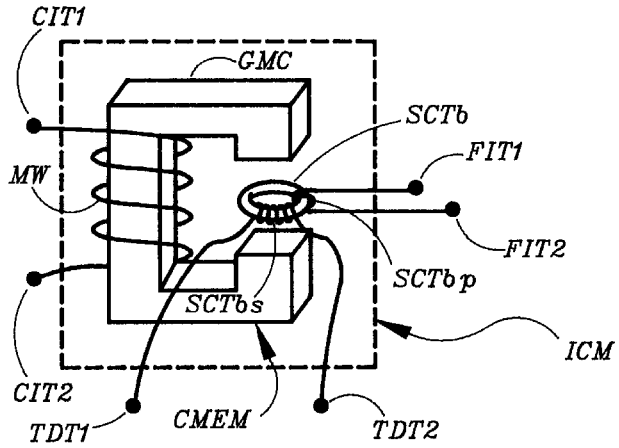
FIG. 2 provides a detailed view of the cross-magnetizing means.

FIG. 2 provides details of inverter control means ICM.

In FIG. 2, a saturable current transformer SCTb has: i) a primary winding SCTbp connected between feedback input terminals FIT1 and FIT2, and ii) a secondary winding SCTbs connected between transistor drive terminals TDT1 and TDT2.

A cross-magnetizing electro-magnet CMEM has a gapped magnetic core GMC; and saturable current transformer SCTb is positioned within the gap thereof.

Gapped magnetic core GMC has a magnetizing winding MW, the terminals of which are connected between control input terminals CIT1 and CIT2.

Figure 3:
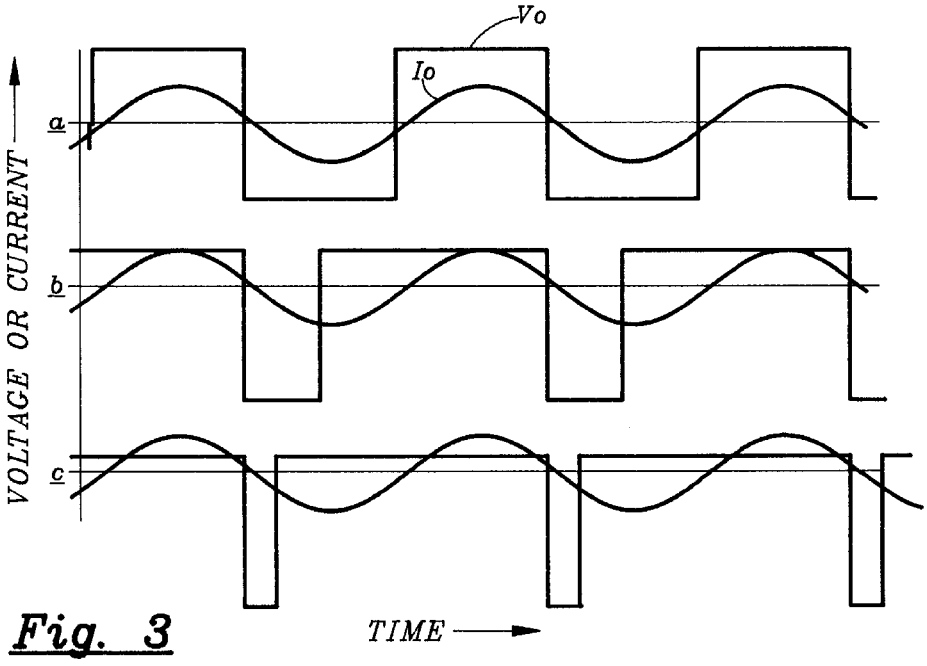
FIG. 3 shows various voltage and current waveforms associated with the operation of the initial embodiment.

FIG. 3 shows various voltage and current waveforms related to the operation of the circuit of FIG. 1.

FIG. 3*a* shows the inverter's output voltage Vo as it exists between junctons Jc and Jx for a situation where there is no cross-magnetization of saturable current transformer SCTb. The corresponding inverter output current is shown as Io.

FIGS. 3*b* and 3*c*, respectively, show the inverter's output voltage Vo as it exists between junctions Jc and Jx for situations with a medium amount and a large amount of cross-magnetization of saturable current transformer SCTb. The corresponding inverter output currents are indicated as Io.

Details of Operation of Initial Embodiment

Except for the cross-magnetizing means, the operation of the half-bridge inverter of FIG. 1 is quite conventional and is explained in conjunction with FIG. 8 of U.S. Pat. No. Re. 31,758 to Nilssen.

For a given magnitude of the DC supply voltage and for a given basic inverter oscillation frequency, the magnitude of the current provided to the load (FL) is a sensitive function of the waveshape of the inverter's squarewave output voltage. Basically, the larger the magnitude of the fundamental frequency component, the higher the power provided to the load.

The basic inverter oscillating frequency is about 30 kHz; and is principally determined by the longer of the forward conduction times (ON-times) of the two inverter transistors (Qa and Qb). As indicated by FIG. 3*a*, without any cross-magnetizing flux applied to the lower saturable current transformer (SCTb), the ON-times are both about the same: about 16 micro-seconds. However, as cross-magnetization is applied, the ON-time of the lower transistor shortens. FIG. 3*b* indicates the shortened ON-time of the lower transistor for a medium amount of cross-magnetization; and FIG. 3*c* indicates the even more shortened ON-time for a relatively large amount of cross-magnetization.

The ON-time of the upper transistor is that length of time when the instantaneous magnitude of the inverter's output voltage Vo is positive while at the same time the inverter's output current Io is also positive; the ON-time of the lower transistor is that length of time when the instantaneous magnitude of the inverter's output voltage Vo is negative while at the same time the inverter's output current Io is also negative.

During other times, the inverter's output current is flowing through each transistor in the reverse direction. For instance, with respect to transistor Qa, after its associated saturable current transformer has reached saturation, reverse current may freely flow from the emitter, through the secondary winding of the saturated transformer SCTa, into the base, and out of the collector.

Details in respect to the effect of the magnetic flux saturation characteristics on a transistor's ON-time (or on the inverter's basic oscillation frequency) are provided in U.S. Pat. No. 4,513,364 to Nilssen.

Specifically, as the saturation flux density of the saturable current transformer is reduced, the associated transistor's ON-time decreases (and, in case of a symmetrical situation, the inverter's basic oscillation frequency increases).

One way of reducing the transformer's saturation flux density is that of increasing the temperature of the ferrite magnetic core used in that transformer; which effect is further explained in U.S. Pat. No. 4,513,364 to Nilssen.

Another way of reducing the transformer's saturation flux density is that of subjecting the transformer's ferrite magnetic core to a cross-magnetizing flux, such as from an adjacently placed permanent magnet or electromagnet. That way, the saturation flux density of the transformer's ferrite magnetic core decreases with increasing cross-magnetizing flux.

Thus, in view of FIGS. 1 and 2, as long as the L-C circuit is substantially series-resonant at the inverter's oscillation frequency whenever there is no cross-magnetization of the saturable feedback current transformer SCTb, it is clear that: i) the higher be the magnitude of the current provided to control input terminals CITa/CITb, ii) the higher be the resulting cross-magnetizing field produced by the electromagnet, iii) the more reduction there be in the saturation flux density of the current transformer's ferrite magnetic core, iv) the shorter be the ON-time of the lower transistor (Qb), v) the lower be the effective magnitude of the squarewave voltage provided from the inverter's output terminals Jc and Jx; and vi) the lower be the magnitude of the current provided to the load.

In other words: the more current be provided to control input terminals CITa/CITb: i) with the fluorescent lamp non-connected and/or inoperative, the lower be the magnitude of the voltage developing across tank-capacitor C; or ii) with the fluorescent lamp connected and operative, the lower be the magnitude of the current provided to the fluorescent lamp.

By providing for a negative feedback arrangement, the circuit of FIG. 1 provides manifest protection against excessive voltages developing across tank capacitor C.

More particularly, the magnitude of the current provided to the control input terminals CITa/CITb is a sharply non-linear function of the magnitude of the high-frequency voltage present at terminals Jc/Jy.

Then, as soon as the peak magnitude of this high-frequency voltage exceeds a predetermined level, current starts flowing through Zener diode ZD and into control input terminals CIT1/CIT2, thereby flowing through magnetizing winding MW of gapped magnetic core GMC, thereby cross-magnetizing saturable current transformer SCT, thereby decreasing the ON-time of the lower transistor, thereby causing a reduction in the effective magnitude of the inverter's output voltage, thereby causing the magnitude of the high-frequency voltage present across terminals Jc/Jy to assume a value that is substantially lower than that which otherwise would have been the case (or, conversely, causing a reduction in the magnitude of the high-frequency current flowing into the load).

The Zener voltage is chosen to be about equal to the peak-to-peak magnitude of the high-frequency voltage required to properly ignite fluorescent lamp FL; which implies that the ON-time of the lower transistor (Qb) will automatically be controlled (increased) just enough to limit the magnitude of the high-frequency voltage between junctions Jc and Jy to be no higher than that required for properly igniting the fluorescent lamp.

As soon as the fluorescent lamp ignites, the magnitude of the high-frequency voltage decreases by a substantial factor, thereby ensuring that no current will be provided to control input terminals CIT1/CIT2 as long as the lamp is indeed in normal operation. That is, the very act of lamp ignition will cause the magnitude of the high-frequency voltage to decrease below the level required to effect conduction of the Zener diode.

Whenever desired, during actual lamp operation, controllable lamp dimming may be effected by providing a control current of adjustable magnitude directly into control input terminals CITa and CITb.

DESCRIPTION OF THE PREFERRED EMBODIMENT

Details of Construction of Preferred Embodiment

Figure 4:
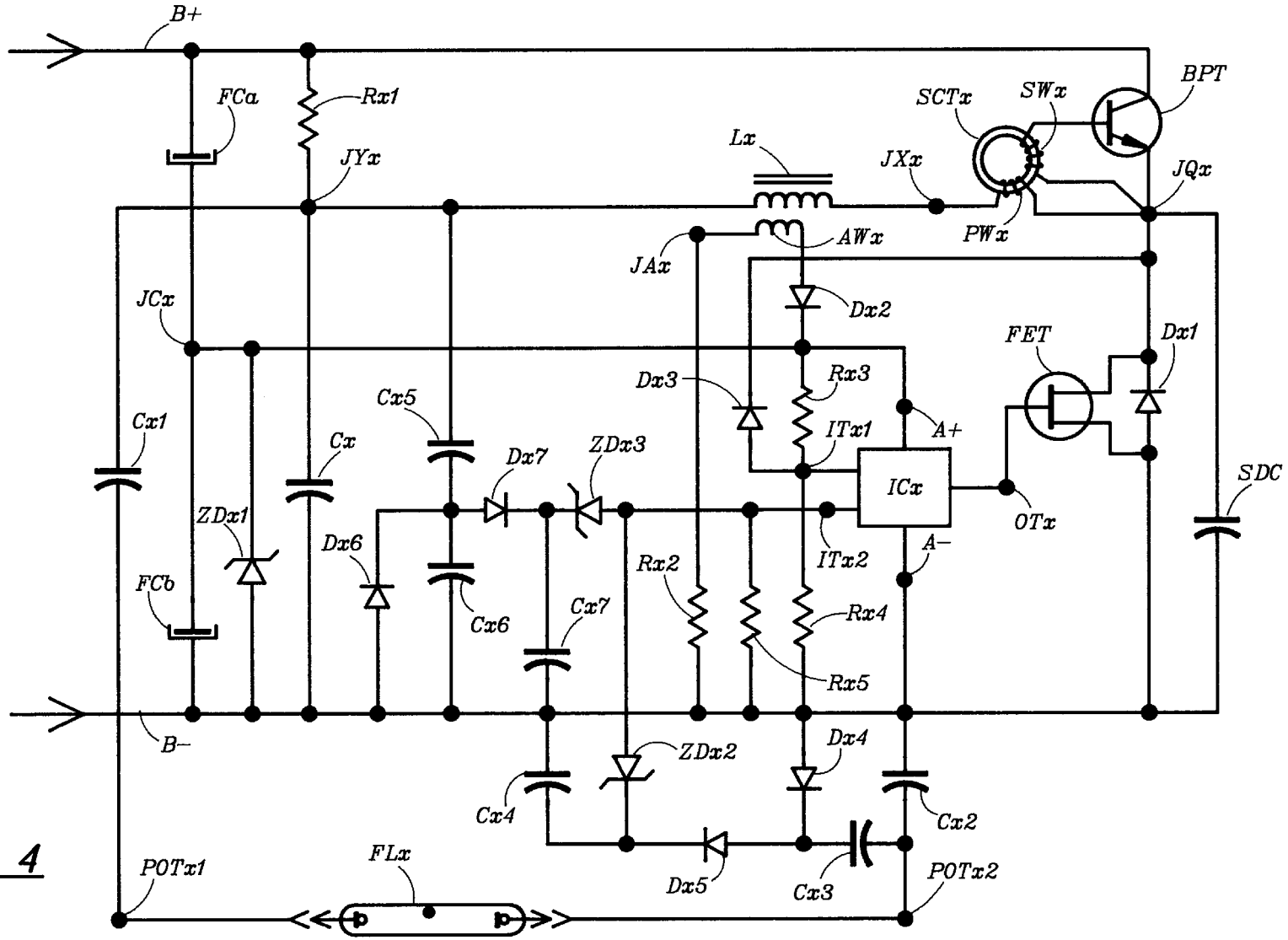
FIG. 4 provides a schematic diagram of a basic version of the preferred embodiment of the invention.

FIG. 4 schematically illustrates the electrical circuit arrangement of the preferred embodiment of the invention.

In FIG. 4, details of the DC power supply circuitry have been eliminated; and the inverter ballast circuit per se is shown to be provided with a DC voltage between the B− bus and the B+bus. A first filter capacitor FCa is connected between a junction JCx and the B+ bus; a second filter capacitor FCb is connected between junction JCx and the B− bus; and a Zener diode ZDx1 is connected between junction JCx and the B− bus, with its cathode connected with junction JCx.

A bipolar transistor BPT is connected with its collector to the B+ bus and with its emitter to a junction JQx; a field effect transistor FET is connected with its drain to junction JQx and with its source to the B− bus; a diode Dx1 is connected across the FET's source and drain, with the anode connected to the source; and a slow-down capacitor SDC is connected between junction JQx and the B− bus. A saturable current transformer SCTx has a primary winding PWx connected between junction JQx and a junction JXx, as well as a secondary winding SWx connected between the base and the emitter of transistor BPT.

A tank inductor Lx is connected between junction JXx and a junction JYx; and a tank capacitor Cx is connected between junction JYx and the B− bus. A resistor Rx1 is connected between junction JYx and the B+ bus.

A capacitor Cx1 is connected between junction JYx and a first power output terminal POTx1; a capacitor Cx2 is connected between the B− bus and a second power output terminal POTx2; and a fluorescent lamp FLx is disconnectably connected between power output terminals POTx1 and POTx2.

An auxiliary winding AWx, which is coupled with tank inductor Lx, has its terminals connected between a junction JAx and the anode of a diode Dx2, whose cathode is connected with junction JCx. A resistor Rx2 is connected between junction JAx and the B− bus.

Junction JCx is connected with the A+ terminal (i.e., the positive DC supply terminal) of an integrated circuit ICx, whose A− terminal (or negative DC supply terminal) is connected with the B− bus. A resistor Rx3 is connected between the A+ terminal and a first input terminal ITx1 of integrated circuit ICx; and a resistor Rx4 is connected between input terminal ITx1 and the B− bus. A diode Dx3 is connected with its anode to first input terminal ITx1 and with its cathode to the drain of field effect transistor FET. An output terminal OTx of integrated circuit ICx is connected with the gate terminal of field effect transistor FET.

A capacitor Cx3 is connected between output terminal POTx2 and the cathode of a diode Dx4, whose anode is connected with the B− bus. A diode Dx5 is connected with its anode to the cathode of diode Dx4 and with its cathode to the cathode of a Zener diode ZDx2, whose anode is connected with an input terminal ITx2 of integrated circuit ICx. A capacitor Cx4 is connected between the cathode of diode Dx5 and the B− bus; and a resistor Rx5 is connected between input terminal ITx2 and the B− bus.

A capacitor Cx5 is connected between junction JYx and the cathode of a diode Dx6, whose anode is connected with the B− bus; a capacitor Cx6 is connected between the cathode of diode Dx6 and the B− bus; and a diode Dx7 is connected with its anode to the cathode of diode Dx6 and with its cathode to the cathode of a Zener diode ZDx3, whose anode is connected with input terminal ITx2 of integrated circuit ICx. A capacitor Cx7 is connected between the cathode of diode Dx7 and the B− bus.

Details of Operation of Preferred Embodiment

Figure 5:
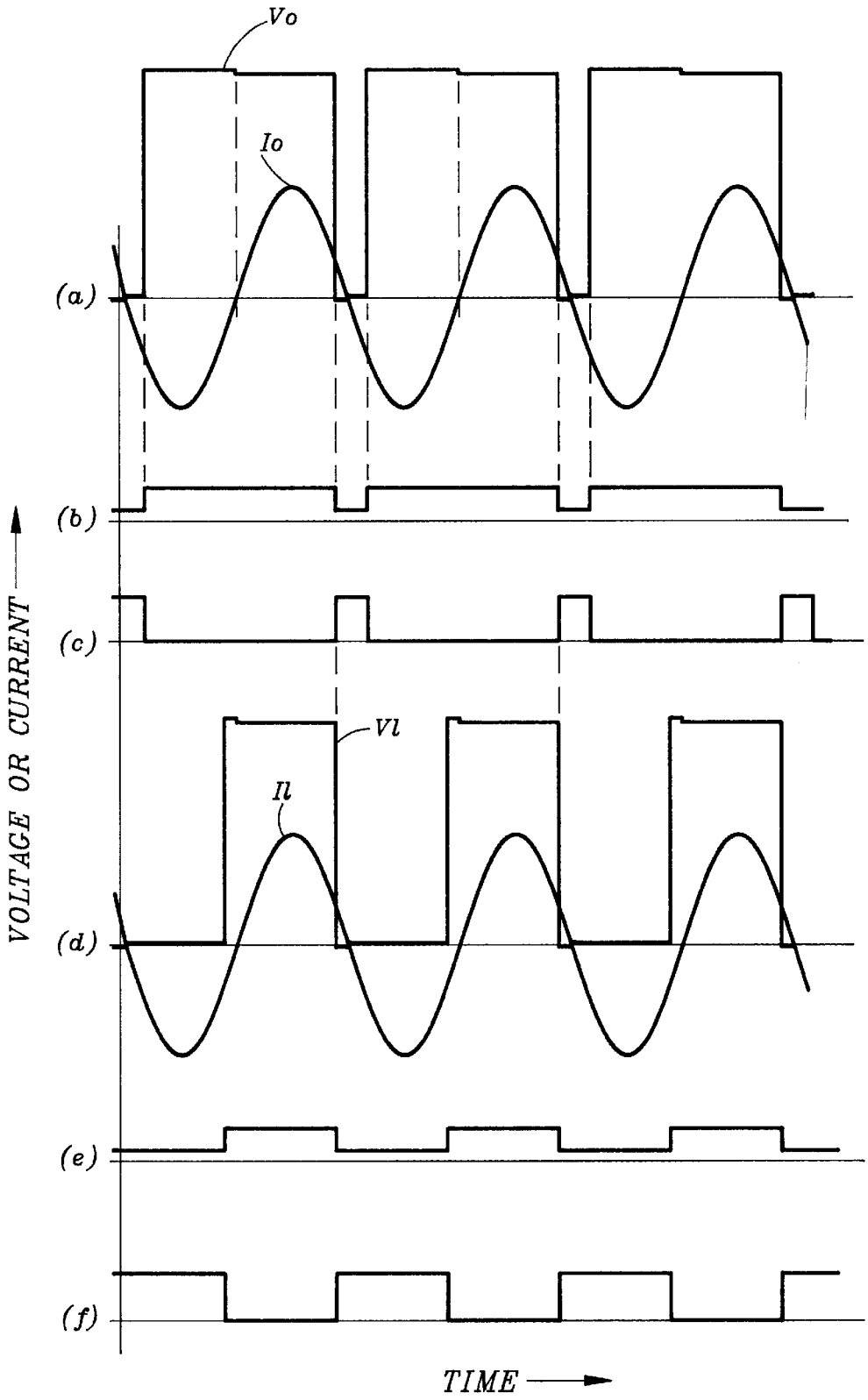
FIG. 5 shows various voltage and current waveforms associated with the operation of the preferred embodiment.

FIG. 5 illustrates some of the voltage and current waveforms associated with the operation of the preferred embodiment of FIG. 4.

In FIG. 5, as referenced to the B− bus: (a) shows the waveform Vo of the voltage existing at the FET's drain prior to lamp ignition; (b) shows the waveform of the voltage existing at input terminal ITx1 prior to lamp ignition; (c) shows the waveform of the voltage existing at the FET's gate prior to lamp ignition; (d) shows the waveform of the voltage V1 of the voltage existing at the FET's drain after lamp ignition; (e) shows the waveform of the voltage existing at input terminal ITx1 after lamp ignition; and (f) shows the waveform of the voltage existing at the FET's gate after lamp ignition.

Also, in FIG. 5: (a) shows the waveform of the current Io flowing through inductor Lx prior to lamp ignition, and (d) shows the waveform of the current I1 flowing through inductor Lx after lamp ignition.

The operation of the circuit of FIG. 4 is substantially the same as that of the circuit of FIG. 1, except for the action of integrated circuit ICx.

In the circuit of FIG. 4, integrated circuit ICx is in effect a triggerable one-shot which times out after a certain pre-determined maximum period, except when provided with a positive-polarity control current (or voltage) at input terminal IPx2, in which case it times out within a period shorter than this certain pre-determined maximum period: the higher the magnitude of the control current, the shorter period for timing out.

The certain pre-determined maximum period is about equal to the period required for saturable current transformer SCTx to time out (i.e., to reach saturation after having been fully reset); which is typically about 12 micro-seconds for a situation when the inverter's output voltage has a fundamental frequency of about 30 kHz.

Like the circuit of FIG. 1, the circuit of FIG. 4 has to be triggered into operation; which triggering may be accomplished in substantially the same manner as that shown in FIG. 1.

In the circuit of FIG. 4, prior to lamp ignition (or with the lamp FLx disconnected), the voltage present at the FET's drain terminal will be as shown in FIG. 5 by the waveform identified as Vo in line (a).

The waveform Vo results from self-oscillating interaction between bipolar transistor BPT and field effect transistor FET; which interaction is caused by saturable current transformer SCTx acting on transistor BPT; which, in turn, acts on integrated circuit ICx, which then acts on transistor FET.

In particular and in part, with a positive voltage of about 15 Volt applied to the A+ terminal of integrated circuit ICx, a positive voltage (of about 6 Volt magnitude) will also be applied to input terminal IPx1. With such a positive voltage applied to input terminal IPx1, integrated circuit ICx functions such as to cause the magnitude of the voltage provided from output terminal OTx to the FET's gate to be so low as to maintain the FET in a non-conductive state. However, whenever the magnitude of the voltage at the FET's drain falls to a sufficiently low level, by action of diode Dx3, the magnitude of the positive voltage at input terminal ITx1 will be reduced to a point where it becomes so low to cause the magnitude of the voltage provided at output terminal OTx abrubtly to increase to a point where the FET is brought into a state of being conductive. Starting at the point in time when the FET is rendered conductive, by way of ordinary one-shot action, integrated circuit ICx now starts a timing cycle whereby, after a maximum predetermined period (e.g., about 12 micro-seconds), it reverses its state, thereby to render the FET non-conductive again.

More particularly and completely, the operation occurs as follows.

Briefly after saturable transformer SCTx saturates (with forward current still flowing through it), transistor BPT abruptly ceases to conduct. Yet, the current flowing through inductor Lx at that point will continue to flow; but, since it can no longer flow through transistor BPT, it must now flow into capacitor SDC. As a result, the voltage at junction JQx—which, just prior to the turn-off of transistor BPT, was at the potential of the B+ bus—will now rapidly fall to the point where it becomes clamped (via diode Dx1) at the potential of the B− bus. Thereafter, the current will continue to flow from inductor Lx (through diode Dx1) until the energy stored therein has been discharged (into the inverter's power supply).

However, the very fact that the magnitude of the voltage on the FET's drain terminal fell to near zero, caused the magnitude of the voltage at input terminal ITx1 to fall to near zero; which therefore caused integrated circuit ICx to provide a voltage at output terminal OTx of magnitude sufficient to render the FET conductive.

As shown at line (f) of FIG. 5, with no input provided to input terminal ITx2, the output from output terminal OTx will be such as to cause the FET to remain conductive for a given duration (e.g., 12 micro-seconds), thereby to cause the inverter's output voltage (i.e., the voltage at junction JQx with reference to the B− bus) to be as shown by waveform V1 in line (d) of FIG. 5. The waveform of the voltage at input terminal ITx1 will be as shown at line (e) of FIG. 5.

As shown at line (c) of FIG. 5, with a certain amount of current provided to input terminal ITx2—such as will be provided via Zener diode ZDx3 in case the magnitude of the voltage at junction JYx were to exceed a pre-determined level—the output from output terminal OTx will be such as to cause the FET to remain conductive for a length of time shorter than said given duration, thereby to cause the inverter's output voltage (i.e., the voltage at junction JQx with reference to the B− bus) to be as shown by waveform Vo in line (a) of FIG. 5. The waveform of the voltage at input terminal ITx1 will be as shown at line (b) of FIG. 5.

The waveforms depicted at lines (a), (b) and (c) of FIG. 5 correspond approximately to the situation existing prior to lamp LFx having ignited (or with the lamp being disconnected); while the waveforms depicted at lines (d), (e) and (f) of FIG. 5 correspond approximately to the situation existing after lamp FLx has ignited and draws a maximum amount of power.

For situations where lamp FLx draws less than the maximum amount of power, such as in a dimmed mode (which is attainable by lowering the resistance value of resistor Rx5), the various voltages will have waveforms intermediary of those of FIG. 5.

On power-up, the A+ voltage required for powering integrated circuit ICx is attained via a voltage-dividing method whereby filter capacitor FCb gets charged to a suitable voltage (e.g., about 15 Volt) by way of the charging current flowing through filter capacitor FCa. (Zener diode ZDx1 prevents excessive voltage build-up on filter capacitor FCb.) After initial power-up, continuous power for integrated circuit ICx is provided by way of auxiliary winding AWx and rectifier Dx2, using filter capacitor FCb for filtering.

Additional Comments (a) Detailed information relative to a fluorescent lamp ballast wherein the fluorescent lamp is powered by way of a series-excited parallel-loaded L-C resonant circuit is provided in U.S. Pat. No. 4,554,487 to Nilssen.

One effect of such a ballasting arrangement is that of making the waveshape of the voltage provided across the output to the fluorescent lamps very nearly sinusoidal, even though the output from the inverter itself, at the input to the series-resonant L-C circuit, is more-or-less of squarewave shape.

(b) The circuit arrangements of FIG. 1 is applicable to various loads and for various reasons. For instance, regardless of the type of load used, the control arrangement disclosed can be used to regulate power output against variations in the magnitude of the power line voltage. Or, in case of the load being a rectifier means and a storage battery requiring to be charged, the ON-time control means can be used to provide the required tapering of the charging current. In situations where an inverter is loaded with a series-resonant parallel-loaded L-C circuit, the control means provided prevents the magnitude of the high-frequency voltage developing across the tank-capacitor of the L-C circuit from reaching destructive levels.

(c) Saturable current transformer SCT requires only a miniscule Volt-Ampere input and the voltage-drop across its primary winding is only a small fraction of one Volt. Hence, the magnitude of the voltage-drop between junctions Jq and Jx is substantially negligible, and the inverter's output voltage is therefore effectively provided between junctions Jx and Jc; which means that the inverter's full output voltage is provided across the series L-C circuit.

(d) To improve loop-gain in the control arrangement, thereby to attain increased control sensitivity, control current to control input terminals CIT1/CIT2 can be drawn from the DC supply voltage by way of a transistor—with the transistor base being controlled with current as provided either: i) in response to the magnitude of the high-frequency voltage present between junctions Jc and Jy, by way of the excess-voltage-magnitude-sensing circuit comprised of elements CC, R, ZD, FC and ID; or ii) in response to the magnitude of an externally provided control signal.

(e) The current waveforms (Io) illustrated in FIG. 3 are not drawn to vertical scale. Rather, they are drawn mainly to indicate the phase relationship between the inverter's output voltage and the inverter's output current. In reality, other things being equal, the magnitude of the current in FIG. 3*a* would be of larger magnitude than that of FIG. 3*b*; which, in turn, would be of larger magnitude than that of FIG. 3*c*.

(f) With reference to the ballast circuit of FIG. 4, in a typical situation, the magnitude of the DC voltage between the B− bus and the B+ bus might be about 300 Volt; which means that filter capacitor FCa should have a voltage rating of at least 285 Volt, provided the Zenering voltage of Zener diode ZDx1 is 15 Volt and that filter capacitor FCb operates with a DC voltage of about 15 Volt across its terminals.

(g) In the ballast circuit of FIG. 4, the magnitude of the 30 kHz voltage present across capacitor Cx2 represents a measure of the magnitude of the 30 kHz current flowing through capacitor Cx2; which, of course, is the same current that flows through fluorescent lamp FLx. Thus, by way of capacitor Cx3 and diodes Dx4/Dx5, the magnitude of the DC voltage developing across capacitor Cx4 is a measure of the magnitude of the 30 kHz current flowing through lamp FLx. Whenever this DC voltage exceeds some desired pre-determined level, current starts flowing through Zener diode ZDx2, thereby to cause the duration of the positive pulse provided from output terminal OTx to shorten; thereby, in turn, to cause the magnitude of the lamp current to be regulated so as to prevent the magnitude of the DC voltage from far exceeding this pre-determined level; thereby correspondingly to prevent the magnitude of the lamp current from far exceeding the desired pre-determined level.

Similarly, the magnitude of the 30 kHz voltage developing across capacitor Cx6 is a measure of the magnitude of the 30 kHz current flowing through it; the magnitude of which current, in turn, is a measure of the magnitude of the 30 kHz voltage present at junction JYx. Thus, via elements Dx6/Dx7 and ZDx3, a DC voltage developing across capacitor Cx7, the magnitude of which DC voltage is a measure of the magnitude of the 30 kHz voltage present at junction JYx; and, whenever the magnitude of this DC voltage exceeds some pre-determined level, current starts flowing through Zener diode ZDx3, thereby to cause the duration of the positive pulse provided from output terminal OTx to shorten; thereby, in turn, to cause the magnitude of the 30 kHz voltage at junction JYx to be regulated so as to prevent the magnitude of the DC voltage across capacitor Cx7 from far exceeding this pre-determined level; which, of course, means that the magnitude of the 30 kHz voltage at junction JYx will be prevented from far exceeding some pre-determined level.

(h) In FIG. 5, although the frequency of the waveforms shown at lines (a)–(c) is indicated as being the same as the frequency of the waveforms shown at lines (d)–(f), the frequency of the waveforms of lines (a)–(c) is actually somewhat higher than those of lines (d)–(f).

That is, when the ON-time of transistor FET is reduced compared with the ON-time of transistor PBT, the net result is a not only the indicated reduction in symmetry of the inverter's AC output voltage but is also an increase in the fundamental frequency of this AC output voltage; both of which effects helps in the control of the magnitude of the AC voltage at junction JYx or in the control of the magnitude of the lamp current.

(i) The AC component of the inverter's output voltage—which is the AC component of the voltage present at junction JQx as referenced to the B− bus—is in fact a squarewave voltage; which is to say that it alternates abrubtly between a first substantially constant voltage level (the voltage level represented by the B− bus) and a second substantially constant voltage level (the voltage level represented by the B− bus).

This squarewave voltage consists of many harmonically related voltage components. It has a fundamental voltage component at a fundamental frequency (e.g., 30 kHz) as well as several harmonically related voltage components at higher frequencies (i.e., at 60 kHz, 90 kHz, 120 kHz, etc.).

For a given peak-to-peak magnitude, as the symmetry of the squarewave voltage is controlled, the magnitude of its fundamental voltage component is correspondingly controlled: the more assymetrical the squarewave voltage, the lower the magnitude of the fundamental (i.e., 30 kHz) voltage component.

Thus, with the lamp load connected with the inverter's output by way of an L-C circuit series-resonant at or near the 30 kHz fundamental frequency of the inverter's more-or-less symmetrical squarewave output voltage, the magnitude of the 30 kHz current flowing through the series L-C circuit and therefore the magnitude of the lamp current (or, if unloaded, the magnitude of the voltage voltage developing across the L-C circuit's tank capacitor) will be proportional to the magnitude of the 30 kHz fundamental voltage component of this squarewave voltage.

Thus, in the ballast circuit of FIG. 4, controlling the degree of assymmetry of the inverter's 30 kHz squarewave output voltage—which has a substantially constant peak-to-peak magnitude and which is applied across a series-connected L-C circuit having a natural resonance frequency at or near 30 kHz—has the effect of controlling the magnitude of the 30 kHz voltage applied across the series-connected L-C circuit.

(j) In the ballast circuit of FIG. 4, the use of a field effect transistor as the switching transistor whose ON-time is controlled has significant advantages over the use for that purpose of a bi-polar transistor for at least three reasons: (i) its switching time is much shorter than that of a bi-polar transistor, therefore permitting the attainment of much shorter ON-times than otherwise would be feasible; (ii) control of the duration of its ON-time is easier to accomplish; and (iii) as long as the field effect transistor is positioned on the "cold" side (i.e., the "non-floating" or the the B− side) of the half-bridge inverter, its gate control circuit uses components of a type that is readily capable of being provided in the form of an IC, whose requisite power supply can readily be provided as a low-cost adjunct to the main filter capacitor of the inverter's DC power supply.

On the other hand, in a half-bridge inverter, the use of a bi-polar transistor as the "floating" switching transistor (i.e., the transistor that is not directly connected with the B− bus) whose ON-time is not controlled has significant advantages over the use for that purpose of a field effect transistor for at least three reasons: (i) its drive signal can be provided very simply by way of a saturable current transformer of miniscule size (i.e., less than 0.1 cubic-centimeter in volume) substantially without use of any auxiliary components; (ii) the requisite electrical isolation (i.e., the "floating") of its drive circuit is automatically attained at no cost by way of an isolated primary winding on this same saturable current transformer; and (iii) the cost of a bi-polar transistor is lower than that of a field effect transistor of the same effective current rating.

(k) As a point of definition, a transistor is considered as being "ON" when it is made to be fully conductive in its regular forward manner, such as occurs when the base-emitter junction of a bi-polar transistor is supplied with forward base current. That is, an ordinary NPN bipolar transistor is considered as being "ON" whenever positive current may flow with substantially no voltage drop from the collector to the emitter; which, of course, occurs whenever a sufficient amount of positive current is supplied to its base.

However, in many field effect transistors, reverse current may flow through the transistor even if the transistor is not in its ON-state. This is so for the reason that many field effect transistors has a built-in diode (such as dioded Dx1 in FIG. 4) permitting such reverse current to flow.

In case of transistor BPT of FIG. 4, even if the transistor is not switched ON, reverse current may freely flow: not through the transistor per se, but via secondary winding SWx through the transistor's base-collector junction.

(l) It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

What is claimed is:

1. An arrangement comprising:

a source operative to provide a substantially constant magnitude DC voltage at a pair of DC terminals;

inverter means connected with the DC terminals and operative to provide an AC output voltage at a pair of inverter terminals; the AC voltage having a fundamental cycle period; the inverter means being characterized by including at least two switching transistors, one of which being a field effect transistor and one being a bipolar transistor;

gas discharge lamp having a pair of lamp terminals; and circuit means connected with the inverter terminals and having output terminals operative to disconnectably connect with the lamp terminals.

2. The arrangement of claim 1 wherein: (i) the field effect transistor is operative to conduct current in its forward direction at least once during each fundamental cycle period; (ii) the bipolar transistor is operative to prevent current from being conducted in its forward direction at least once during each fundamental cycle period; and (iii) the field effect transistor is operative to conduct current in its forward direction only during times when the bipolar transistor is operative to prevent current from being conducted in its forward direction.

* * * * *